US006170691B1

(12) United States Patent
Morris, Sr. et al.

(10) Patent No.: US 6,170,691 B1
(45) **Date of Patent: *Jan. 9, 2001**

(54) OPEN-HEAD CONTAINER AND LID ASSEMBLY

(75) Inventors: Glenn H. Morris, Sr.; Glenn H. Morris, Jr., both of Chattanooga, TN (US)

(73) Assignee: M & M Industries, Inc., Chattanooga, TN (US)

( * ) Notice: Under 35 U.S.C. 154(b), the term of this patent shall be extended for 0 days.

This patent is subject to a terminal disclaimer.

(21) Appl. No.: 09/165,346

(22) Filed: Oct. 2, 1998

Related U.S. Application Data

(63) Continuation-in-part of application No. 08/942,786, filed on Oct. 2, 1997, now Pat. No. 6,006,942.

(51) Int. Cl.[7] ..... B65D 41/04; B65D 45/20

(52) U.S. Cl. ..... 220/304; 220/326; 206/508

(58) Field of Search ..... 220/304, 288, 220/795, 315, 324, 326, 345.6, 806, 378, 783; 206/508, 520, 515, 501; 215/329, 330, 341, 352, 792, 801, 803, 804, 806

(56) References Cited

U.S. PATENT DOCUMENTS

| | | | | |
|---|---|---|---|---|
| 1,232,741 | | 7/1917 | West . | |
| 1,498,416 | | 6/1924 | Willett . | |
| 2,084,568 | | 6/1937 | White . | |
| 2,459,668 | * | 1/1949 | Melichar | 220/304 |
| 2,906,429 | * | 9/1959 | Marchyn | 220/304 |
| 2,907,492 | | 10/1959 | Robertson . | |
| 3,058,527 | | 10/1962 | Dennis et al. . | |
| 3,127,049 | * | 3/1964 | Welty et al. | 220/304 |
| 3,128,005 | | 4/1964 | Sherlock . | |
| 3,181,718 | | 5/1965 | Chancellor . | |
| 3,311,253 | | 3/1967 | Peachacek . | |
| 3,458,079 | | 7/1969 | Gasbarra . | |
| 3,648,876 | | 3/1972 | Berman . | |
| 3,897,874 | | 8/1975 | Coons . | |
| 3,942,679 | | 3/1976 | Starr . | |
| 3,977,563 | | 8/1976 | Holt . | |
| 4,063,639 | | 12/1977 | Grant . | |
| 4,154,354 | | 5/1979 | Ryder . | |
| 4,198,040 | | 4/1980 | Colasent . | |
| 4,244,920 | * | 1/1981 | Manschot et al. | 220/288 |
| 4,245,753 | | 1/1981 | Ellis . | |
| 4,293,080 | | 10/1981 | Letica . | |
| 4,308,970 | | 1/1982 | Von Holdt . | |
| 4,347,947 | * | 9/1982 | Hammes | 220/378 |
| 4,434,910 | | 3/1984 | Groult . | |
| 4,491,238 | * | 1/1985 | Tobolt | 220/783 |
| 4,494,674 | | 1/1985 | Roof . | |

(List continued on next page.)

*Primary Examiner*—Nathan J. Newhouse
(74) *Attorney, Agent, or Firm*—Birch, Stewart, Kolasch & Birch, LLP

(57) ABSTRACT

A container assembly includes a container member having an open end, and a lid threadably engagable with the container member for closing the open end of the container member. A locking member is provided on the lid which is engagable with a latch member located on an upper surface of the container member. The locking member is pivotable about a horizontal axis and prevents rotation of the lid with respect to the container member when the locking member is engaged with the latch member. A seal is provided between the lid and the container member. The seal is located between wall members of the lid and the container member such that the seal is gradually compressed as the lid is threadably secured to the container member. The lid and the container member each include opposing rims which abut one another when the lid is secured to the container member to maintain the seal in a horizontally compressed state, and to prevent the lid from being blown off of the container member if the container assembly is dropped and large pressures develop inside of the container assembly.

38 Claims, 13 Drawing Sheets

U.S. PATENT DOCUMENTS

| | | | |
|---|---|---|---|
| 4,732,288 | 3/1988 | Morris, Sr. . | |
| 4,819,824 | 4/1989 | Longbottom et al. . | |
| 4,967,926 | 11/1990 | Morris, Sr. . | |
| 4,978,004 | 12/1990 | Silverstein et al. . | |
| 5,052,576 | 10/1991 | Budenbender . | |
| 5,125,538 | 6/1992 | Morris, Sr. . | |
| 5,147,060 | 9/1992 | Lima et al. . | |
| 5,167,344 | 12/1992 | Van Schilt | 220/288 X |
| 5,190,181 | 3/1993 | Budenbender . | |
| 5,295,601 | 3/1994 | Bostelman . | |
| 5,328,047 * | 7/1994 | Smith | 220/795 |
| 5,377,858 | 1/1995 | Morris, Sr. . | |
| 5,452,748 | 9/1995 | Simmons et al. . | |
| 5,503,187 | 4/1996 | Simmons et al. . | |
| 5,915,575 | 6/1999 | Morris, Sr. | 220/304 X |
| 5,944,214 | 8/1999 | Conti et al. | 220/304 |
| 5,947,462 | 9/1999 | Roussel | 220/324 X |
| 6,006,942 | 12/1999 | Morris, Sr. et al. | 220/288 |

* cited by examiner

OPEN-HEAD CONTAINER AND LID ASSEMBLY

This application is a Continuation-In-Part of U.S. application Ser. No. 08/942,786, filed Oct. 2, 1997, now U.S. Pat. No. 6,006,942 the entire contents of which are hereby incorporated by reference.

BACKGROUND OF THE INVENTION

1. Field of the Invention

The present invention relates to a container assembly having a lid threadably securable to an open head container member. More particularly, the present invention relates to a seal located between the lid and the container member which is gradually compressed as the lid is threadably attached to the container member. A horizontally pivotable locking member is provided on the lid which engages a plurality of teeth on the container member to prevent the lid from loosening during shipment.

2. Description of the Background Art

Various open head container and lid assemblies are known in the art. For example, applicant's prior U.S. Pat. No. 4,967,926, the entire contents of which are hereby incorporated by reference, discloses a container member having a lid securable thereto with a pair of locking members pivotable about a vertical axis for engaging teeth located on the interior side wall of the container member. Further, U.S. Pat. Nos. 4,494,674 and 3,897,874 each disclose a seal located between a container member and a lid which is compressed between adjacent horizontal surfaces.

While these arrangements are useful for providing a seal between a lid and an open head container, and a latch mechanism for preventing unintentional rotation of the lid, the amount of sealing is limited to the strength of the user, and manipulation of the latching mechanism can be difficult. There exists a need in the industry to provide an open head container and lid assembly having a seal located between the lid and the container member which is gradually compressed as the lid is rotatably threaded onto the container member such that the strength necessary to properly apply the lid and compress the seal is reduced, while still providing the necessary sealing ability to prevent liquids from leaking past the seal. Further, there exists a need in the industry to provide a latching mechanism which may be easily manipulated by simply depressing a locking member located on the lid to allow rotation of the lid with respect to the container member.

SUMMARY OF THE INVENTION

Accordingly, it is an object of the present invention to provide an open head container and lid assembly having a locking member pivotable about a horizontal axis which is easily manipulated by a user.

It is a further object of the present invention to provide an open head container and lid assembly having a locking member which permits the lid to be threadably secured to the container member, while preventing the lid from inadvertently unthreading from the container member during shipment.

Yet another object of the present invention is to provide an open head container and lid assembly which includes a seal located between tapered surfaces of the lid and the container member such that compression of the seal occurs gradually as the lid is threadably secured onto the container member. Yet still another object of the present invention is to provide a sealing arrangement between a lid and an open head container member which presents a tortuous path for fluid movement therebetween when the lid is secured to the container member.

These and other objects of the present invention are fulfilled by a container assembly including a container member having an open end and a first thread, and a lid having a second thread for closing the open end of the container member. The locking member is located on the lid which selectively engages a latch member located on the container member to prevent rotation of the lid with respect to the container member in at least one direction of rotation. The lid and the container member include tapered wall members having a seal located therebetween which is gradually compressed therebetween as the lid is threadably secured to the container member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
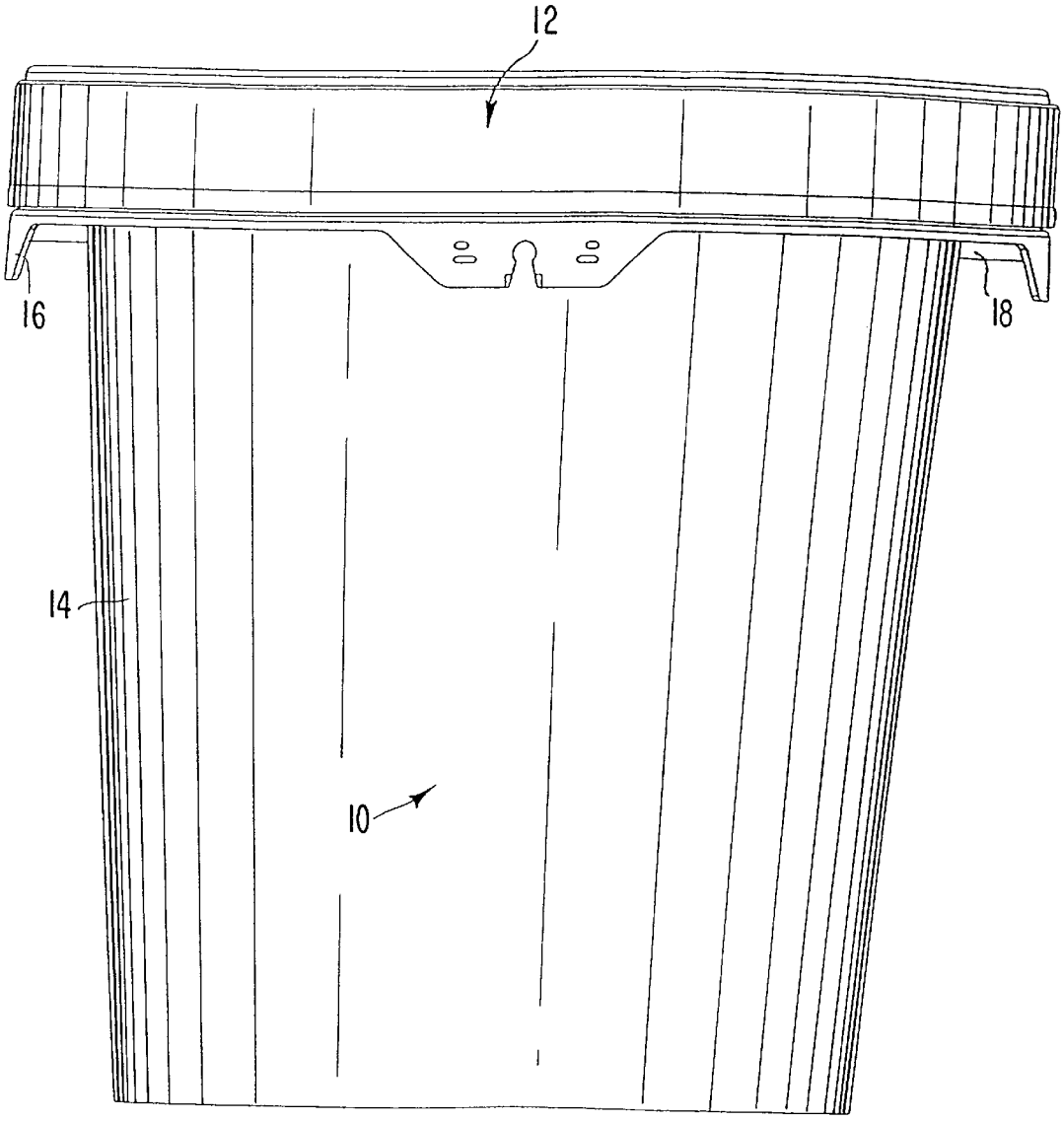
FIG. 1 is a side elevational view showing a lid secured to a container member.

Referring in detail to the drawings and with particular reference to FIG. 1, an open head container member 10 is shown. A lid 12 is threadably mounted to the open head container member 10 adjacent the open end of the container member 10. The container member 10 and lid 12 are preferably formed of molded plastic. The container member 10 may be any suitable size, with a five gallon container member being illustrated in the preferred embodiment. The container member 10 includes a main body portion 14 and an annular skirt member 16 spaced from and encircling the main body portion 14 adjacent the open end of the container member 10. A plurality of reinforcing webs 18 are arranged between the main body portion 14 and the annular skirt member 16. The webs 18 may extend radially outwardly from the main body portion 14, or may extend outwardly from the main body portion 14 at an angle inclined with respect to the radial direction. Alternatively, the plurality of webs 18 may be replaced by a single disk encircling the main body portion 14, and interconnecting the main body portion 14 with the annular skirt member 16. In the preferred embodiment, eight reinforcing webs 18 are utilized spaced equidistantly around the circumference of the main body portion 14.

Figure 2:
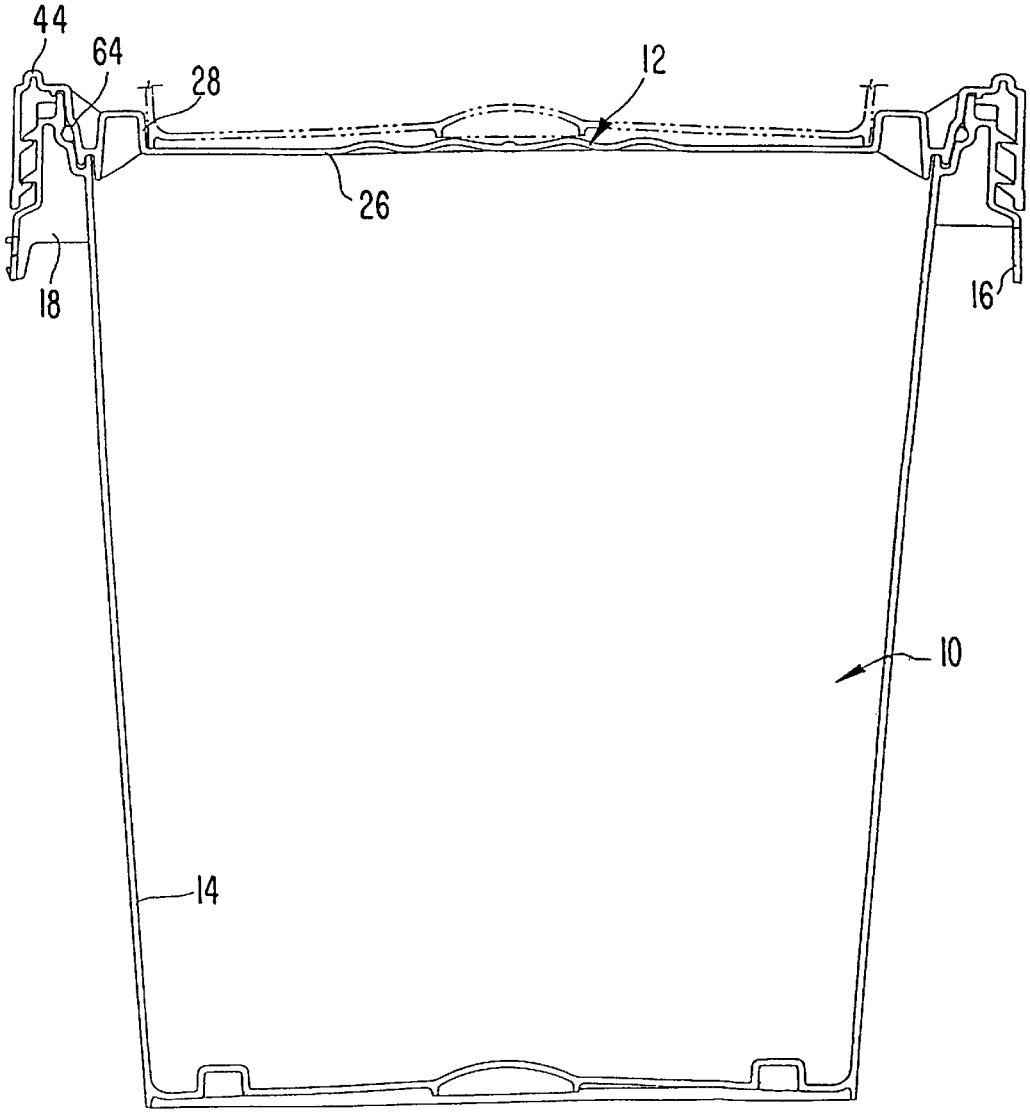
FIG. 2 is a side sectional view showing the lid secured to the container member with the seal sandwiched therebetween.
Figure 4:
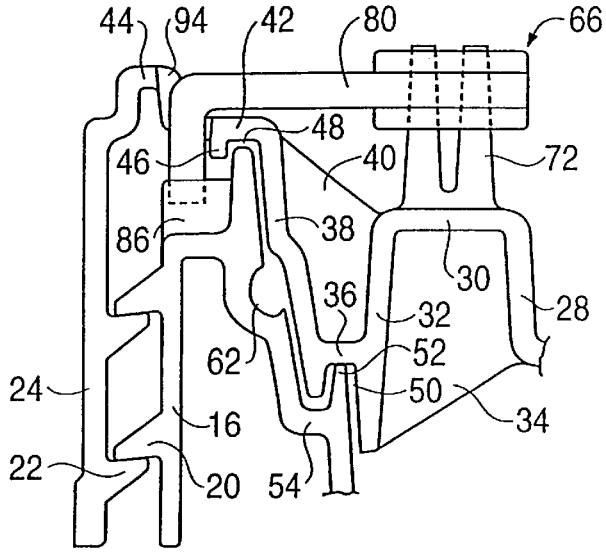
FIG. 4 is a sectional view showing the relationship between the latching mechanism and the sealing arrangement between the lid and the container member.
Figure 5:
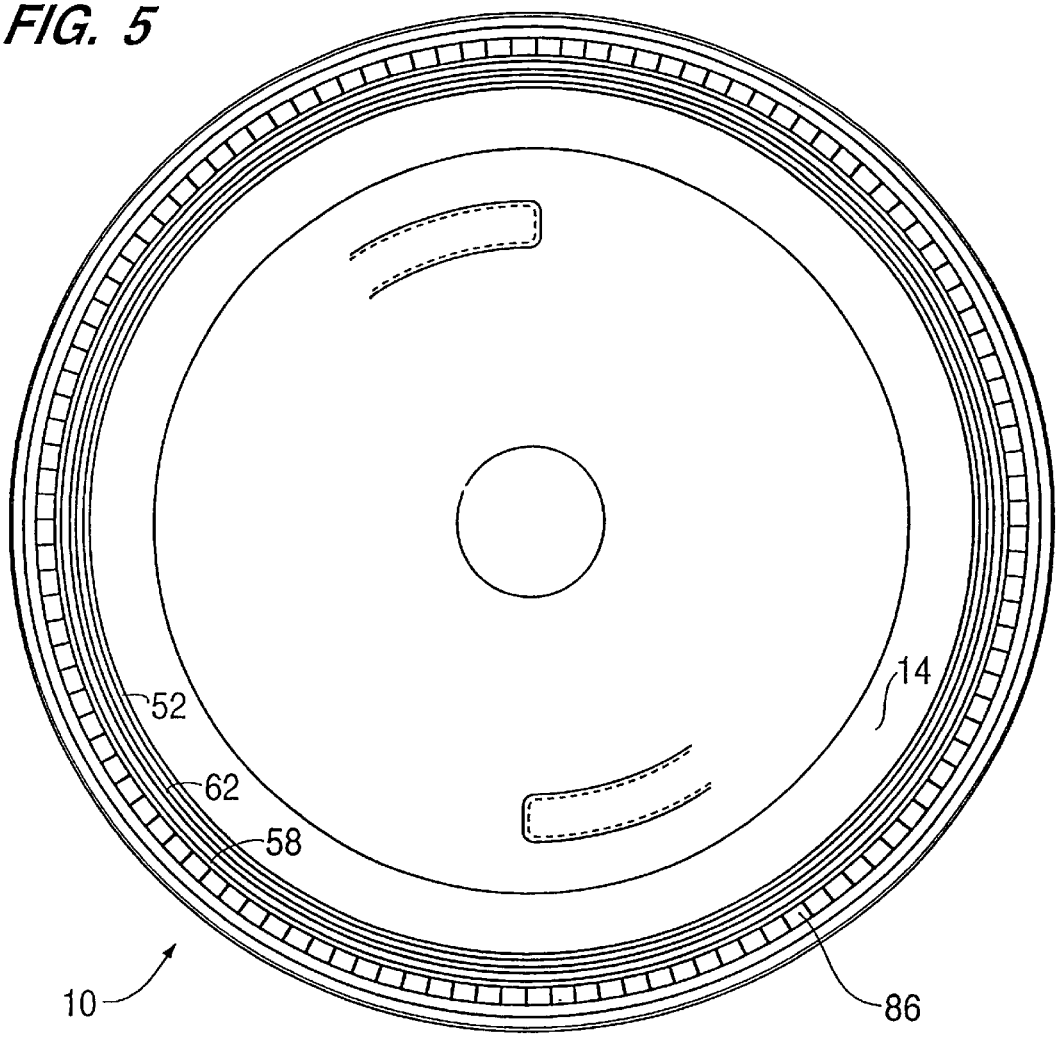
FIG. 5 is a plan view of the open head container with the lid removed, showing the arrangement of the teeth on the upper surface near the upper rim of the container member.

The outer surface of the annular skirt member 16 includes outwardly directed threads 20, as shown in FIGS. 2 and 4. The lid 12 includes inwardly directed threads 22 located on an interior surface of an outermost wall 24 of the lid 12. The inwardly directed threads 22 are threadably engageable with the outwardly directed threads 20 to threadably secure the lid 12 to the container member 10.

Tapered threads are shown in the embodiments due to their fluid sealing characteristics. However, it should be understood that various types of threads may be utilized, such as straight or square threads without departing from the spirit of the present invention.

Although right-hand threads have been shown in the present invention, it should be apparent that in some applications, the use of left-hand threads and/or multiple parallel threads may be utilize.

Figure 3:
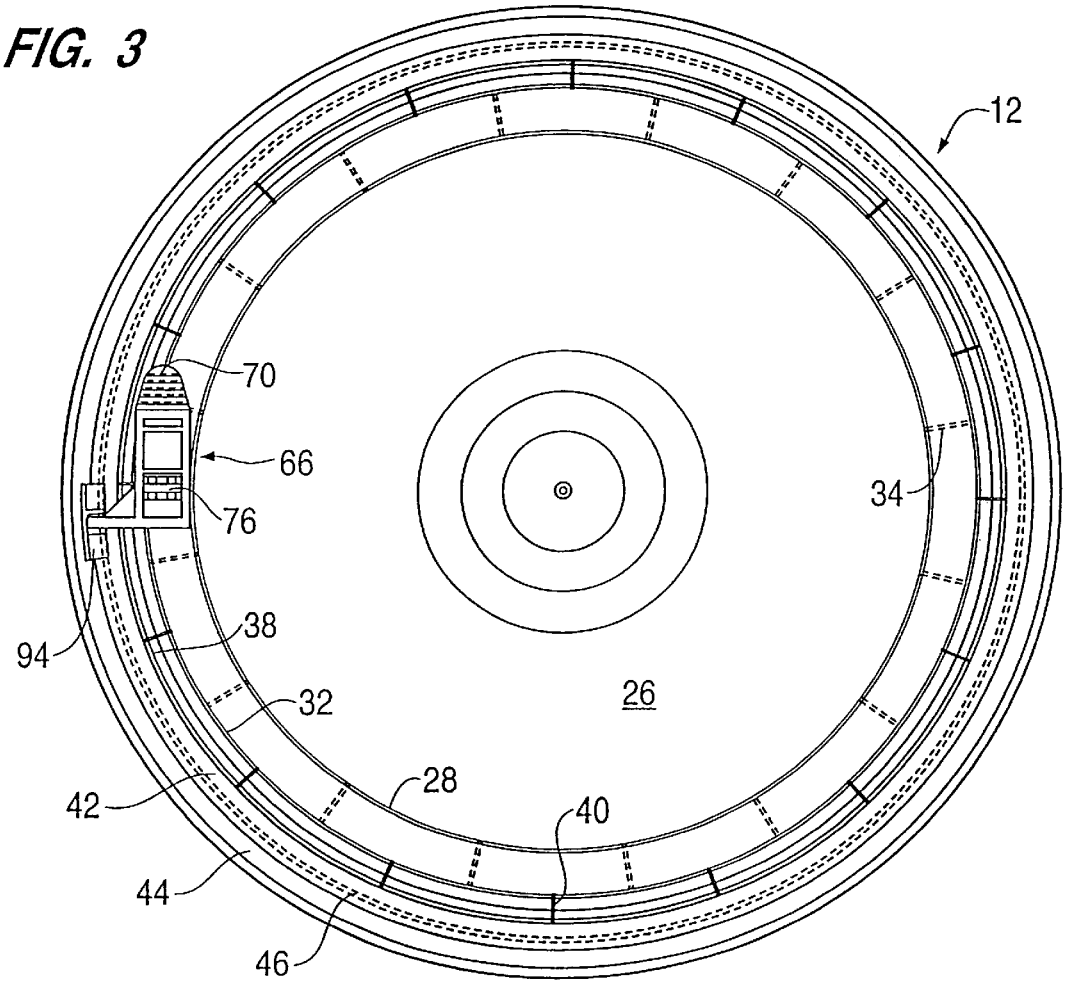
FIG. 3 is a plan view of the lid, and showing the locking member of the present invention.

The details of the construction of the lid 12 are illustrated in FIGS. 2 and 3, where it will be seen that the lid 12 comprises a central disk member 26, to which a first upwardly extending wall member 28 is attached. A middle wall member 30 is attached to the top of the first upwardly extending wall member 28 and extends radially outwardly therefrom. Extending downwardly from the middle wall member 30 is a second upwardly extending wall member 32. Together the first upwardly extending wall member 28, the middle wall member 30 and the second upwardly extending wall member 32 form an inverted U-shaped portion of the lid 12, in which a plurality of internal gussets 34 are located. The internal gussets 34 extend along a radial direction and are preferably located at circumferentially equidistant locations around the lid 12. In the preferred embodiment, sixteen internal gussets 34 are located on the lid 12. These internal gussets 34 face the interior of the container assembly when the lid 12 is secured to the container member 10.

Extending radially outwardly from the second upwardly extending wall member 32 is a lower wall member 36. An inclined or tapered wall member 38 is attached to an outermost portion of the lower wall member 36. Together the second upwardly extending wall member 32, the lower wall member 36 and the tapered wall member 38 form a U-shaped channel in which a plurality of external gussets 40 are arranged. The external gussets 40 extend radially outwardly at circumferentially equidistantly spaced locations around the lid 12. In the preferred embodiment, sixteen external gussets 40 are positioned around the lid 12 approximately midway between adjacent internal gussets 34 as shown in FIG. 3.

A majority of the tapered wall member 38 extends upwardly and outwardly from the lower wall member 36, with only a small lowermost portion of the tapered wall member 38 extending downwardly from the lower wall member 36. To the upper end of the tapered wall member 38 is attached an upper wall member 42 extending radially outwardly therefrom. The upper wall member 42 includes a raised annular protrusion 44 extending upwardly therefrom.

A downwardly extending circumferential protrusion 46 extends downwardly from an interior portion of the upper wall member 42. Together the downwardly extending circumferential portion 46, a portion of the upper wall member 42 and a portion of the tapered wall member 38 form an upper inverted U-shaped channel 48, the purpose of which will be described in more detail below. Also, together the lowermost portion of the tapered wall member 38, the lower wall member 36, and a lower portion of the second upwardly extending wall member 32 form a lower inverted U-shaped channel 50, the purpose of which will be described in more detail below.

The details of the upper portion of the container member 10 will now be described, with particular reference to FIGS. 4 and 7. The open upper end of the main body member 14 includes a lower annular rim 52. A lower wall member 54 extends radially outwardly from the main body portion 14 from a position below the lower annular rim 52. An inclined or tapered wall member 56 extends upwardly from the lower wall member 54. The upper portion of the tapered wall member 56 forms an upper annular rim 58. Together the lower annular rim 52, the lower wall member 54 and a portion of the tapered wall member 56 form a U-shaped channel 60.

Located approximately midway along with tapered wall member 56 is a groove 62 for receiving an O-ring seal 64 therein. The O-ring 64 is preferably formed of a resilient elastomeric material such as rubber.

When the lid 12 is assembled with the open head container member 10, the O-ring seal 64 is compressed between the tapered wall member 56 of the container member 10 and the tapered wall member 38 of the lid 12 to effectively form a seal therebetween. Due to the inclined or tapered arrangement of at least one of the sealing surfaces, as the lid 12 is threadably tightened onto the container member 10, the tapered wall member 38 gradually contacts and begins to compress the O-ring seal 64. Further rotation and tightening of the lid 12 with respect to the container member 10 results in gradual compression of the O-ring seal 64, taking advantage of the mechanical advantage associated with the thread pitch and the tapered wall members 38, 56 to gradually compress the O-ring seal 64 therebetween.

Although in the present invention the O-ring seal 64 is located in the tapered wall member 56 of the container member 10, it should be understood that the O-ring seal 64 may alternatively be located in the tapered wall member 38 of the lid 12. Still further, each of the tapered wall members 38, 56 may include an O-ring seal which each engage portions of the opposing tapered wall member 38, 56.

In addition to the O-ring seal 64, the arrangement of the U-shaped channels 48, 50, 60 provides a tortuous path for inhibiting the passage of fluid therepast and the resultant fluid leakage associated therewith. Specifically, when the lid 12 is assembled with the container member 10, the upper annular rim 58 is located within the upper inverted U-shaped channel 48, the lowermost portion of the tapered wall member 38 is located within the U-shaped channel 60, and the lower annular rim 52 is located within the lower inverted U-shaped channel 50, which together further aid in reducing or eliminating the ability of fluid to leak therepast The depth of the channel 50, as well as the extension of the lower annular rim 52, can be increased to ensure that the rim 52 is retained within the channel 50 even under severe impact which may cause large pressures to develop within the closed container assembly.

A locking arrangement for preventing rotation of the lid 12 with respect to the container member 10 will now be described in detail, with particular reference to FIGS. 3, 4, 6 and 8–10. The locking arrangement includes a locking member 66 located primarily on an outer upper surface of the lid 12. The locking member 66 is configured to provide a child-resistant mechanism to prevent the lid 12 from being removed from the container member 10 unless the locking member 66 is properly manipulated. It should be understood that although only one locking member 66 is shown in the Figures, a second locking mechanism may be provided on the lid 12.

The locking member 66 includes a lever arm 68 having a thumb engaging portion 70 located at one end thereof. A pair of upstanding support posts 72 extend upwardly from the lid 12 for supporting the lever aim 68. The upper ends of the upstanding support posts 72 include a channel 74 therein for receiving a pivot shaft 76 of the lever arm 68 therein.

The pivot shaft 76 is located within the channel 74 to provide a horizontal pivot axis for the lever arm 68. An arcuate or elliptical spring member 78 extends downwardly from the lever arm 68 from a location between the pivot shaft 76 and the thumb engaging portion 70. The spring member 78 biases the lever arm 68 upwardly away from the upper surface of the lid 12. The elliptical spring member 78 is preferably molded of plastic material integral with the locking member 66.

Located on the other side of the pivot axis formed by the pivot shaft 76 is a cross member 80 extending transversely from one side of the lever arm 68. A downwardly extending pawl member extends downwardly from the distal end of the cross member 80. A reinforcing gusset 85 is arranged between the cross member 80 and the lever arm 68.

Figure 6:
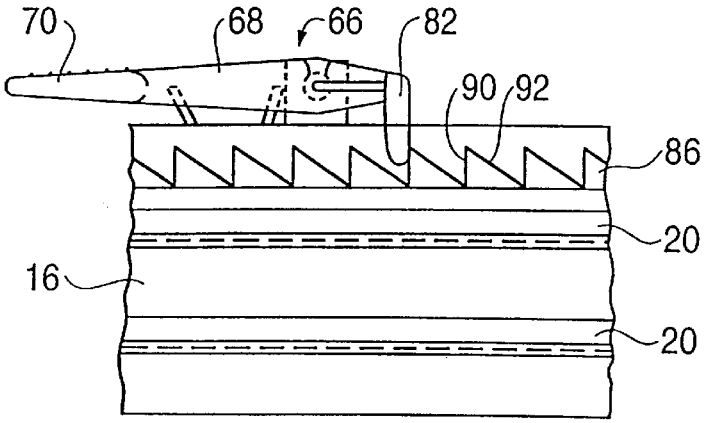
FIG. 6 is a partial side view looking inwardly showing the details of the latching mechanism.

A plurality of upwardly-facing teeth 86 are arranged around the open end of the container member 10. The teeth 86 extend upwardly from a horizontal interconnecting wall member located between the annular skirt member 16 and the tapered wall member 56. The plurality of teeth 86 are selectively engaged by the pawl member 82 of the latching mechanism, as shown in FIG. 6, when the lid 12 is assembled with the container member 10. The teeth 86 each include a substantially vertical face 90 which inhibits movement of the pawl member 82 therepast, and an inclined face 92 which permits movement of the pawl member 82 thereover. As such, the locking member 66 prevents rotation of the lid 12 with respect to the container member 10 in one direction of rotation, while permitting rotation of the lid 12 with respect to the container member 10 in an opposition direction, due to the configuration of the teeth 86 and their interaction with the pawl member 82. The pawl member 82 is configured to extend through a cut-out 94 extending through a portion of the upper wall member 42 of the lid 12 and a portion of the raised annular protrusion 44, as shown in FIGS. 3 and 4.

Figure 8:
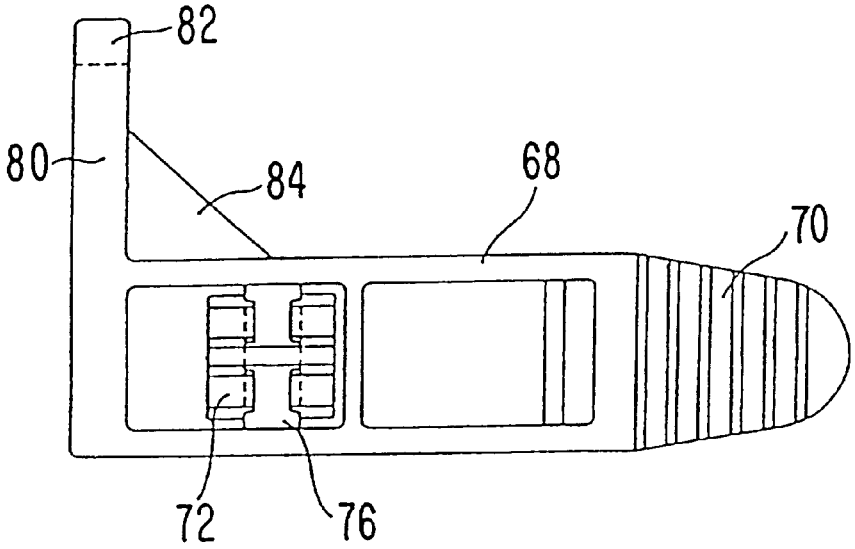
FIG. 8 is a plan view of the locking member of the present invention.
Figure 9:
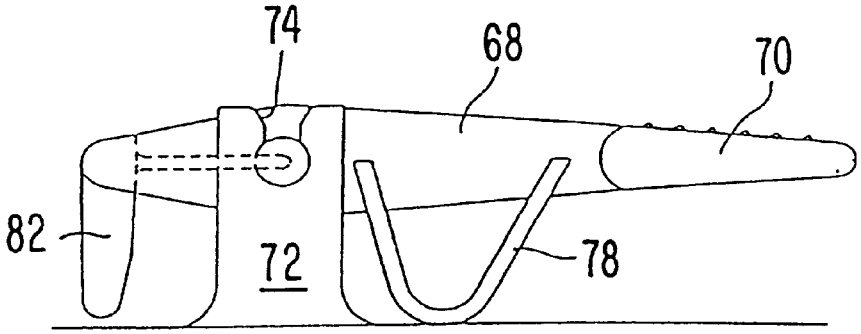
FIG. 9 is a side sectional view of the locking member taken along lines 9—9 of FIG. 8.
Figure 10:
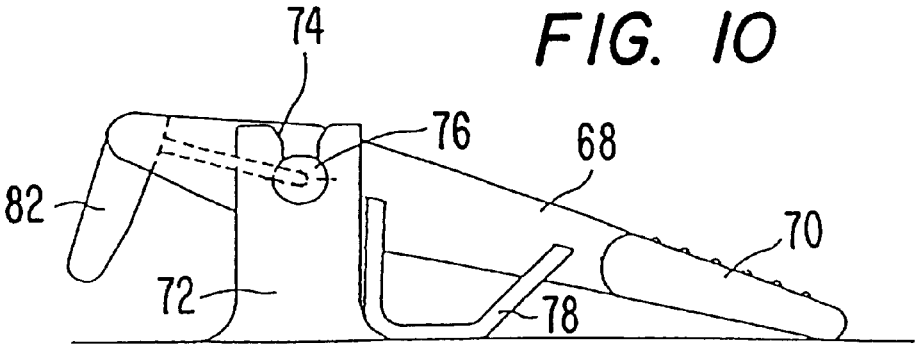
FIG. 10 is a side view of the locking member in an actuated orientation with the spring compressed and the catch member disengaged.

In operation, the pawl member 82 extends in a direction toward the plurality of teeth 86 under the biasing force provided by the spring member 78 such that the pawl member 82 is biased into engagement with respective ones of the teeth 86 when the lid 12 is assembled with the container member 10. The pawl member 82 is offset from the pivot axis formed by the pivot shaft 76 of the lever arm 68, and is also offset from a longitudinal axis extending centrally along the lever arm 68, as shown in FIG. 8.

Figure 11:
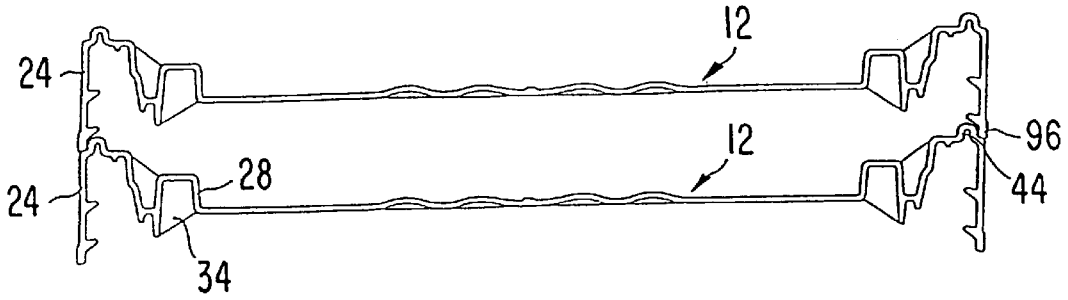
FIG. 11 is a sectional view showing the nesting ability of the lids.

The configuration of the various surfaces of the container member 10 and the lid 12 lends itself well to the ability of each of these elements to nest within one another for efficiently storing the respective elements, or efficiently stacking one upon another to produce a stacked pallet load. As shown in FIG. 11, when one lid 12 is placed upon another lid 12 in a nesting relationship, the lower outer circumferential edge 96 surrounds the outermost portion of the raised annular protrusion 44 of the lower lid 12 to nest the lids 12 with respect to one another and prevent lateral shifting thereof.

Figure 12:
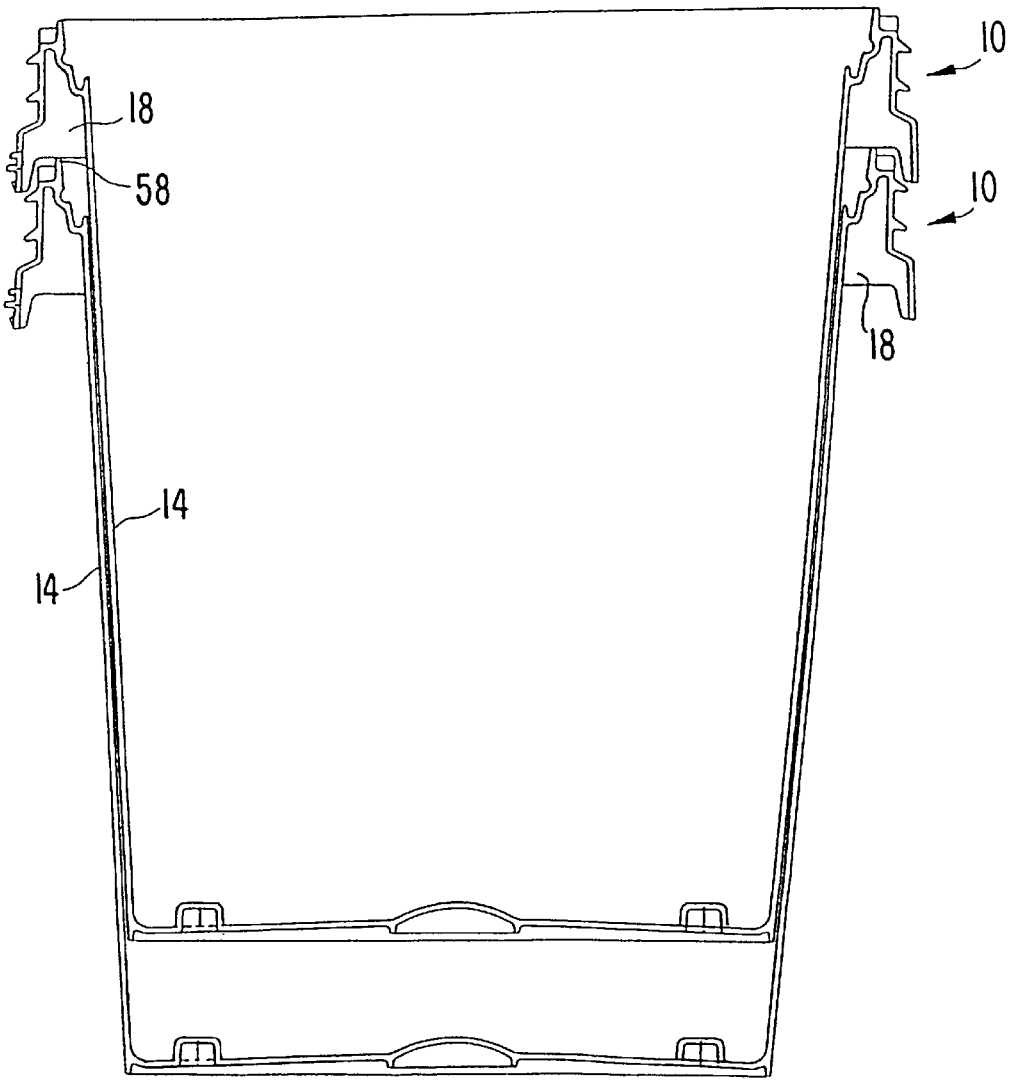
FIG. 12 is a sectional view showing the nesting ability of the container members.

Similarly, as shown in FIG. 12, an open head container member 10 may nestably receive a second container member 10 therein such that lower edges of the reinforcing webs 18 of the upper inner container member 10 rest on the upper annular rim 58 of the lower outer container member 10 to prevent the main body portion 14 of the inner container member 10 from becoming jammed within the main body portion of the outer container member 10.

Figure 14:
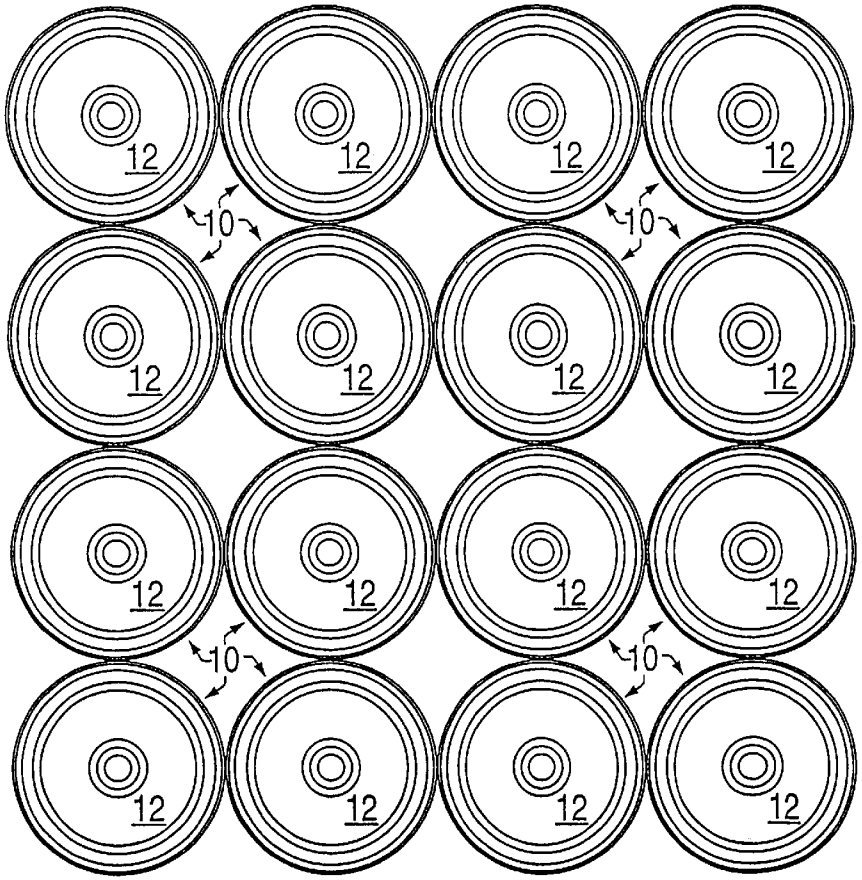
FIG. 14 is a plan view showing a pallet load arrangement for a plurality of stacked container assemblies.
Figure 13:
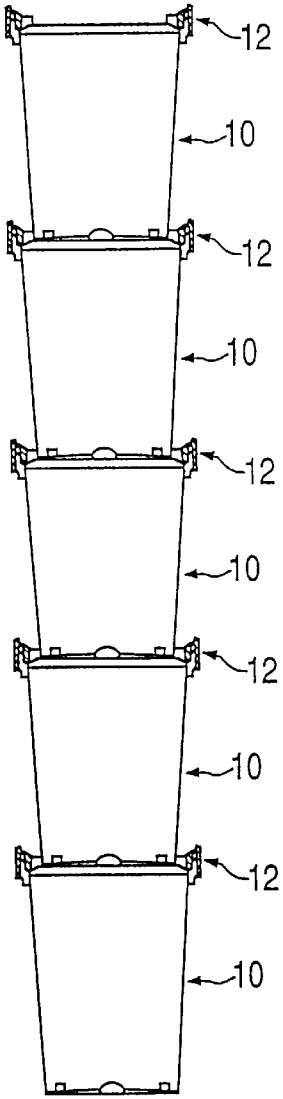
FIG. 13 is a side view showing the stacking ability of a plurality of container assemblies.

As shown in FIG. 13, a plurality of container assemblies having the lids 12 secured to the container members 10 may be stacked one upon the other such that a lower outer circumferential edge of an upper container member 10 is nestably received within the first upwardly extending wall member 28 of the lid 12 of a lower container assembly. This can be more clearly seen in FIG. 2. Also, as shown in FIG. 14, a plurality of stacked containers may be placed side-by-side to efficiently form a pallet load.

Figure 7:
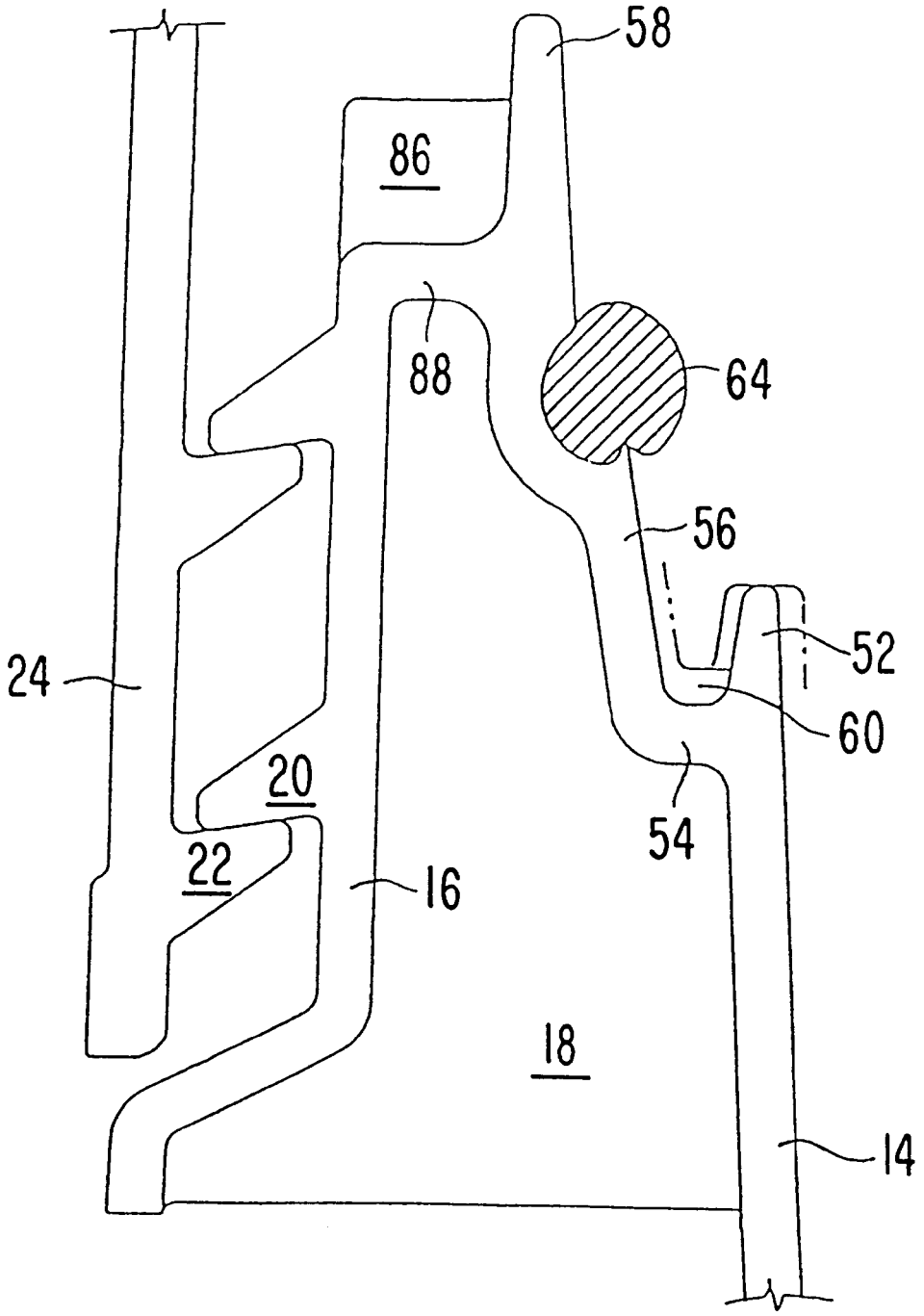
FIG. 7 is a partial sectional view showing the details of the sealing arrangement.
Figure 15:
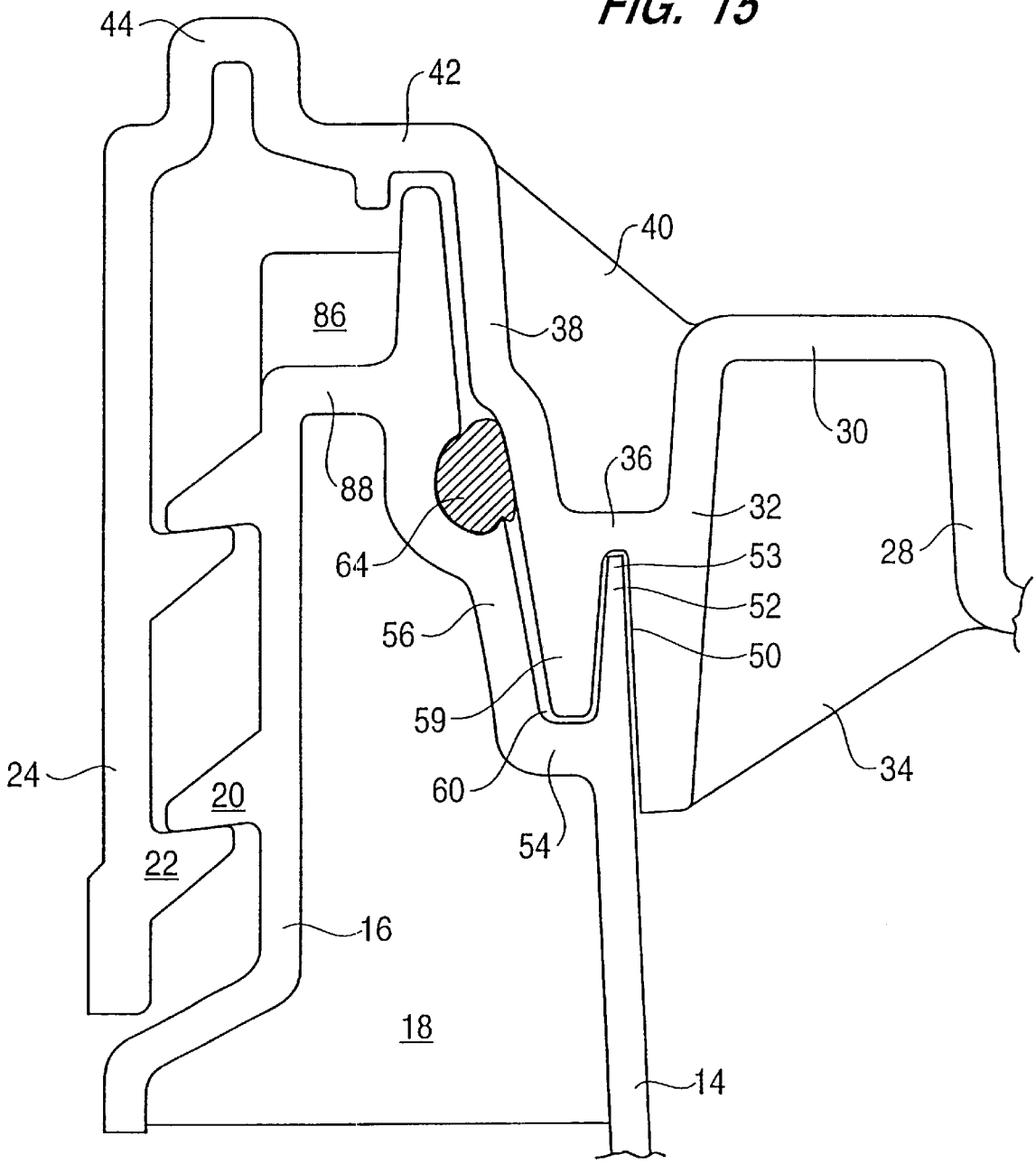
FIG. 15 is a partial sectional view showing the details of an alternate sealing arrangement utilizing an abutting relationship.

FIG. 15 shows a modified form of the sealing arrangement shown in FIG. 7. In the FIG. 15 embodiment, the lowermost portion of the tapered wall member 38 is lengthened to form a downwardly-directed rim 59, and the upper portion of the lower annular rim 52 is lengthened to form an upwardly-directed rim 53. Thus, the U-shaped channel 60 and the lower inverted U-shaped channel 50 are deeper than the embodiment shown in FIG. 7. Further, when the lid 12 is assembled with the open head container member 10, and the O-ring seal 64 is compressed between the tapered wall member 56 and the tapered wall member 38, the upwardly-directed rim 53 becomes abutted against the lower portion of the second upwardly extending wall member 32 and/or the downwardly-directed rim 59. Thus, it becomes very difficult for any material inside of the container member 10 to enter into the lower inverted U-shaped channel 50. Further, the abutting relationship of the upwardly-directed rim 53 with the wall members 32, 38 prevents the lid 12 from deflecting away from the container member 10 when a large pressure is produced inside of the closed container, such as by an impact when the filled container member 10 is dropped. Thus, pressure forces which develop inside of the closed container 10 which may tend to force the lid 12 upwardly, will not be sufficient to cause the downwardly-directed rim 59 to become dislocated from its position within the U-shaped channel 60. Further, the abutting relationship between the upwardly-directed rim 53 and the downwardly-directed rim 59 will hold the seal 64 in the compressed position against the taped wall member 38. Thus, the downwardly-directed rim 59 of the lid extends deeply into the U-shaped channel 60 to prevent dislodgement of the lid 12 from the container member 10 and further, due to the abutting relationship between the downwardly-directed rim 59 and the upwardly-directed rim 53 of the container, keeps the seal 64 in a compressed position when the lid 12 is secured to the open head container member 10.

Figure 16:
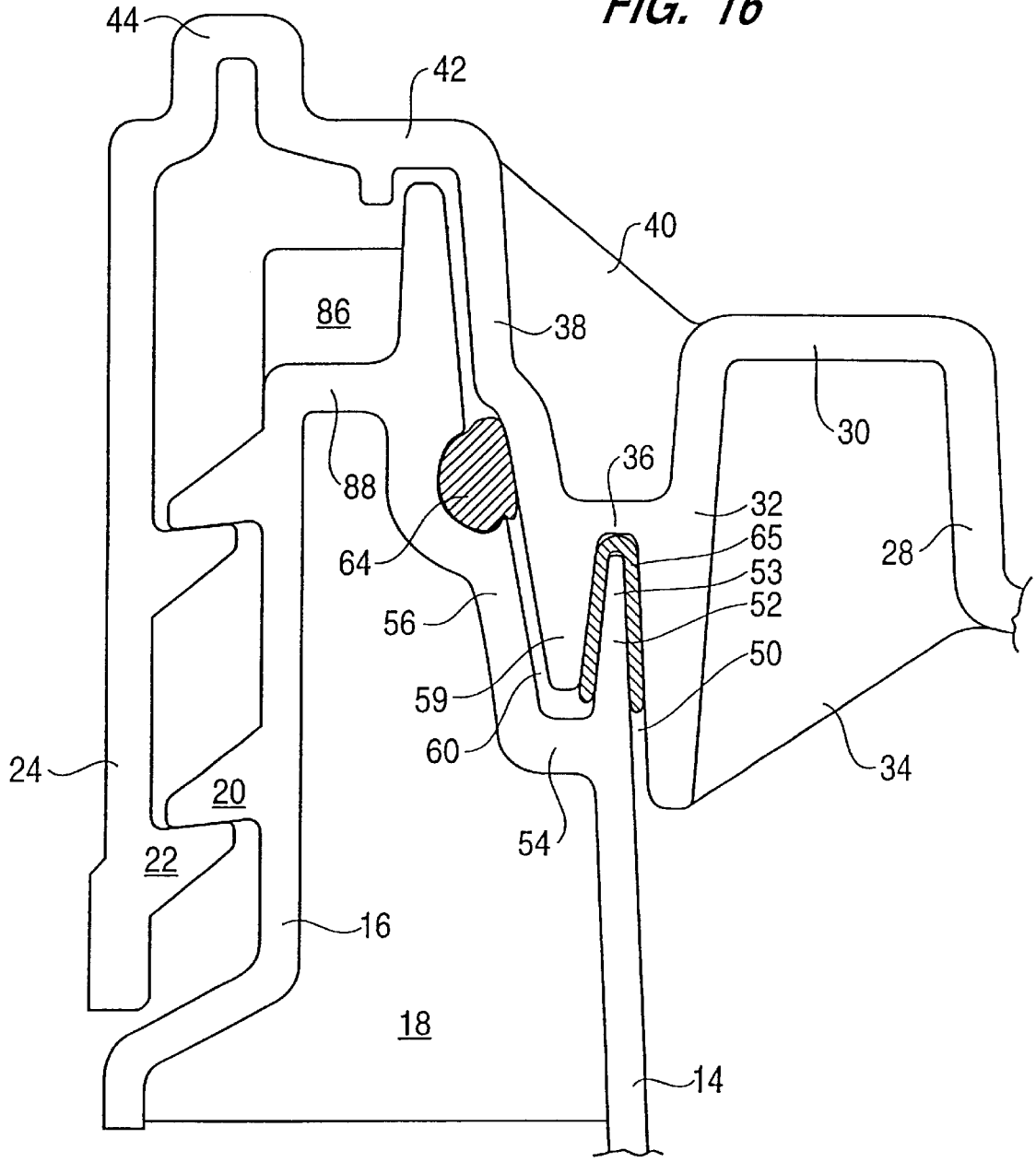
FIG. 16 is a partial sectional view showing the details of an alternate sealing arrangement having a second sealing member.

FIG. 16 shows a modified form of the sealing arrangement shown in FIG. 15. In FIG. 16, a gasket 65 is located in the lower inverted U-shaped channel 50. The gasket 65 is compressed between the downwardly-directed rim 59 and the upwardly-directed rim 53, as well as compressed between the lower portion of the second upwardly extending wall member 32 and the upwardly-directed rim 53. The gasket 65 prevents contents within the open head container member 10 from passing through the lower inverted U-shaped channel 50. Further, because the gasket 65 is resilient, a force is applied thereby to force the downwardly-directed rim 59 away from the upwardly-directed rim 53 to maintain compression of the seal 64 against the tapered wall member 38.

Figure 17:
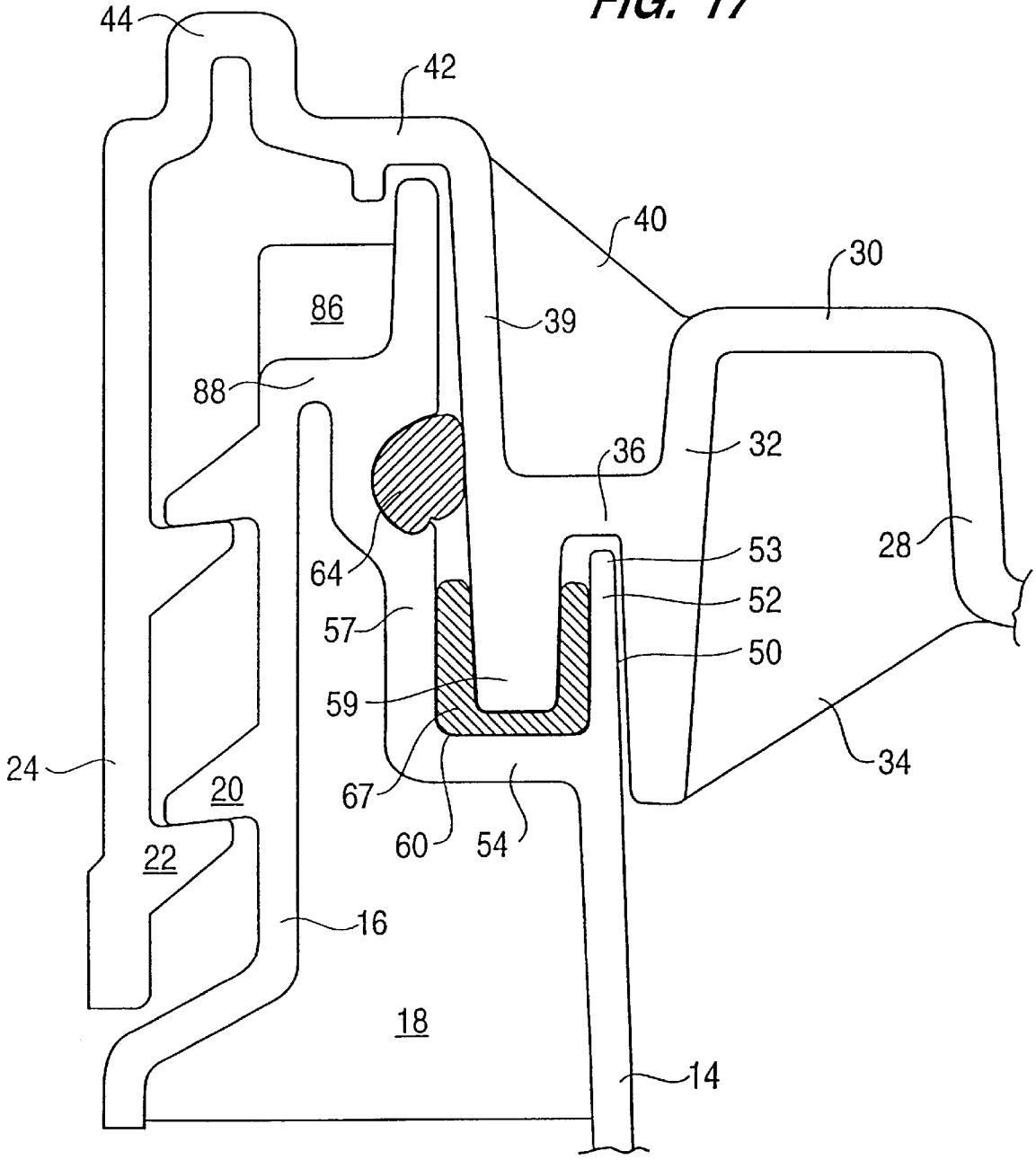
FIG. 17 is a partial sectional view showing the details of an alternate sealing arrangement having a vertical sealing surface and a second sealing member.

FIG. 17 shows a further modification of the sealing arrangement in FIG. 17, the tapered wall member 56 of the FIG. 16 embodiment is replaced by a substantially vertical wall member 57. The substantially vertical wall member 57 includes a groove for retaining the seal 64 therein in the same manner as the embodiment shown in FIG. 7. Additionally, a tapered wall member 39 is provided to extend downwardly from the upper wall member 42 similarly to the tapered wall member 38 of the FIG. 7 embodiment. However, the tapered wall member 39 shown in FIG. 17 is substantially straight and does not include the bent portion confronting the seal 64 as the FIG. 7 embodiment does. Instead, the seal 64 is compressed between the substantially vertical wall member 57 and the flat portion of the tapered wall member 39. As the lid 12 is threaded onto the open head container member 10, the seal 64 will become compressed due to the inclined nature of the tapered wall member 39, and the compression of the seal 64 will occur gradually. In addition, the FIG. 17 embodiment includes a gasket 67 which surrounds the downwardly-directed rim 59 and is located within the U-shaped channel 60. The gasket 67 serves to prevent material within the container member 10 from reaching the seal 64 to provide an additional seal. The gasket 67 further serves to keep the seal 64 in a compressed state.

Figure 18:
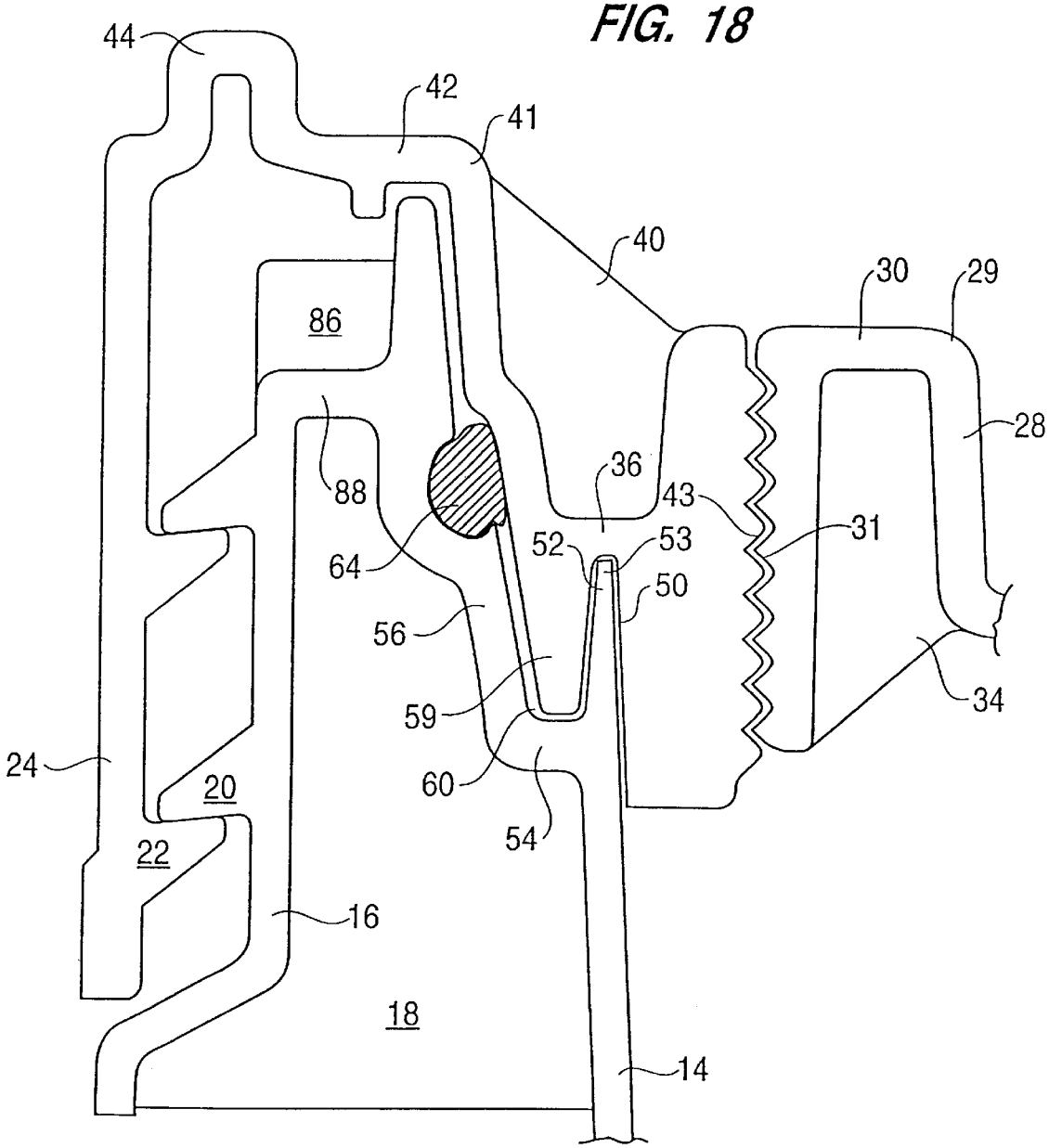
FIG. 18 is a partial sectional view showing the details of a two-piece lid assembly.

FIG. 18 shows a modification of the lid 12. In the FIG. 18 embodiment, the lid is formed as a two-piece unit comprised of an inner disk member 29 and an annular ring member 41. The disk member 29 is attached to the ring member 41 by an interface such as male threads 31 on the disk member 29 and female threads 43 on the ring member 41. However, it should be understood that alternate arrangements of interfaces between the disk member 29 and the ring member 41 can be utilized, such as a snap-fit assembly, a pressure-fit assembly, or an adhesive or welded/bonded assembly.

Figure 19:
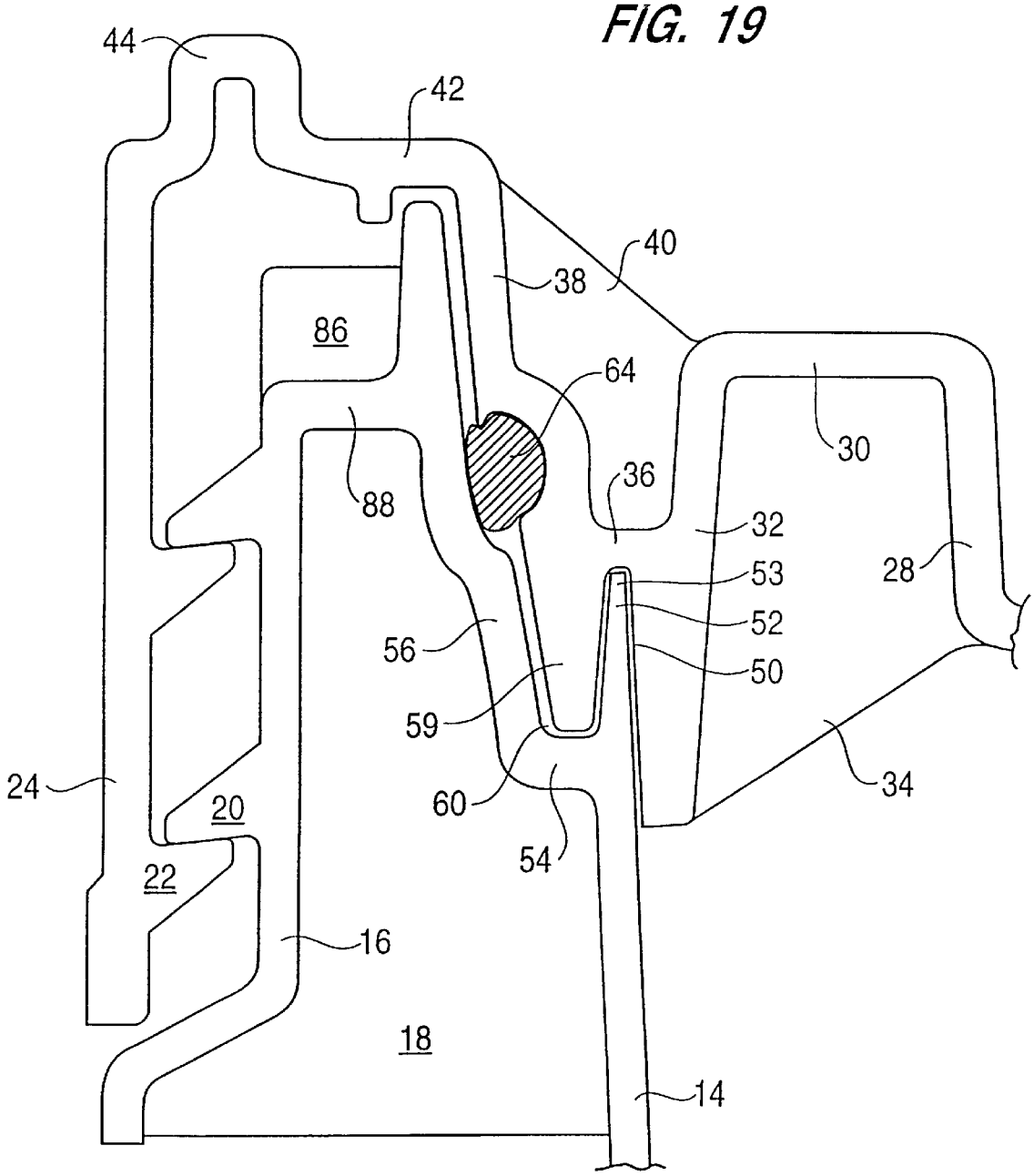
FIG. 19 is a partial sectional view showing the details of an alternate sealing arrangement with the seal located on the lid.

FIG. 19 shows an alternative arrangement of the seal 64 mounting arrangement wherein the seal 64 is located in a groove located in the tapered wall member 38 of the lid, which is pressed against the tapered wall member 56. Thus, FIG. 19 demonstrates that the seal 64 may be located on the lid 12 as opposed to being mounted on the container member 10 as shown in the previous embodiments. Also, in the FIG. 19 embodiment, the abutting nature of the upwardly-directed rim 53 against the downwardly-directed rim 59 retains the seal 64 in the compressed state, to provide an effective seal. Further, the depth of the U-shaped channels 50, 60 with the rims 53, 59 projecting therein prevents the seal 64 from being dislocated or blown off of the container member 10 if a large pressure develops within the closed container member 10.

It should be understood that the present invention is not limited to each of the specific embodiments as separately shown, but may include features of each of the various embodiments in any combination. Also, in the FIG. 19 embodiment, the tapered wall member 38 may be replaced by a substantially vertical wall member similar to the wall member 57 of the FIG. 17 embodiment, and which includes the seal 64. Thus, it should be clear that both of the wall members 38, 56 need not be inclined with respect to vertical, but instead, either one of them may be substantially vertical and still provide the gradual horizontal squeezing the seal 64 as the lid 12 is applied to the container 10. Further, it should be understood that the container 10 of the present invention can be used for liquid, as well as solid or gas material.

Although in a preferred embodiment, the container assembly includes both the sealing arrangement and the latching arrangement, it should be understood that each of these features may be utilize independently. Further, although the present invention has been described with reference to an open head container member 10, it should be understood that the present invention is not limited to use with a container, but is instead applicable to any threaded closure assembly for covering an access opening.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A container assembly comprising:

a container member having an open end, said container member including a first thread, said container member further including an inwardly facing wall member, an upwardly-directed rim adjacent a lower portion of said inwardly facing wall member, with a channel being formed between said inwardly facing wall member and said upwardly-directed rim;

a lid for closing said open end of said container member, said lid including a second thread engageable with said first thread on said container member, said lid further including an outwardly facing wall member having a downwardly-directed rim; and a seal located on one of said inwardly facing wall member and said outwardly facing wall member for engaging the other of said outwardly facing wall member and said inwardly facing wall member, respectively, when said lid is assembled with said container member, whereby application of said lid to said container member by rotatably threading said lid onto said container member gradually applies pressure to said seal between said inwardly facing wall member and said outwardly facing wall member to gradually compress said seal therebetween, and said downwardly-directed rim is located in said channel between said inwardly facing wall member and said upwardly-directed rim, with a sidewall of said downwardly-directed rim abutting a sidewall of said upwardly-directed rim to maintain said seal in a compressed state, and wherein said inwardly facing wall member and said outwardly facing wall member are free of threads along their entire length, and a path between said seal and an interior of said container member is free of threads when said lid is threadably engaged with said container member.

2. The container assembly according to claim 1, wherein said inwardly facing wall member is inclined with respect to vertical and said outwardly facing wall member is substantially vertical.

3. The container assembly according to claim 1, wherein said outwardly facing wall member is inclined with respect to vertical and said inwardly facing wall member is substantially vertical.

4. The container assembly according to claim 1, wherein said inwardly facing wall member and said outwardly facing wall member are inclined with respect to vertical.

5. The container assembly according to claim 1, wherein said seal is located in a groove formed in said inwardly facing wall member.

6. The container assembly according to claim 1, wherein said seal is located in a groove formed in said outwardly facing wall member.

7. The container assembly according to claim 1, wherein said seal is an elastomeric O-ring.

8. The container assembly according to claim 1, wherein said upwardly-directed rim and said downwardly-directed rim are annular and continuous.

9. The container assembly according to claim 1, wherein said channel is U-shaped.

10. The container assembly according to claim 1, further comprising a gasket located between said sidewall of said downwardly-directed rim and said sidewall of said upwardly-directed rim.

11. The container assembly according to claim 10, wherein said gasket surrounds an end portion of said downwardly-directed rim.

12. The container assembly according to claim 10, wherein said gasket surrounds an end portion of said upwardly-directed rim.

13. The container assembly according to claim 1, wherein said inwardly facing wall member is adjacent said open end of said container member.

14. The container assembly according to claim 1, wherein said lid comprises a disc portion, a ring portion, and a connector for interconnecting said disk portion to said ring portion.

15. The container assembly according to claim 14, wherein said connector includes male threads located on said disk portion, and female threads located on said ring portion.

16. The container assembly according to claim 1, said container member further including an annular skirt member spaced from and encircling at least a main body portion of said container member adjacent said open end, said skirt member having an outer surface including said first thread.

17. A container assembly comprising:

a container member having an open end, said container member including a first thread, said container member further including an inwardly facing wall member, an upwardly-directed rim adjacent a lower portion of said inwardly facing wall member, with a channel being formed between said inwardly facing wall member and said upwardly-directed rim;

a lid for closing said open end of said container member, said lid including a second thread engageable with said first thread on said container member, said lid further including an outwardly facing wall member having a downwardly-directed rim;

a seal located on one of said inwardly facing wall member and said outwardly facing wall member for engaging the other of said outwardly facing wall member and said inwardly facing wall member, respectively, when said lid is assembled with said container member;

a latch member located on an upper surface of the container member; and a locking member located on said lid, said locking member including a catch member releasably engagable with said latch member, said locking member further including a lever arm pivotally attached to said lid and pivotal about a horizontal axis for moving said catch member into and out of engagement with said latch member, whereby application of said lid to said container member by rotatably threading said lid onto said container member gradually applies pressure to said seal between said inwardly facing wall member and said outwardly facing wall member to gradually compress said seal therebetween, and said downwardly-directed rim is located in said channel between said inwardly facing wall member and said upwardly-directed rim, with a sidewall of said downwardly-directed rim abutting a sidewall of said upwardly-directed rim to maintain said seal in a compressed state, and whereby said locking member prevents rotation of said lid with respect to said container member in at least one direction of rotation.

18. The container assembly according to claim 17, wherein the latch member comprises a plurality of upwardly facing teeth, the catch member extends in a direction toward said plurality of teeth, said locking member including a spring for biasing the catch member into engagement with respective ones of said teeth when said lid is assembled with said container member, and the locking member permits rotation of said lid with respect to said container member in a first direction of rotation, and prevents rotation of said lid with respect to said container member in a second opposite direction of rotation.

19. A container assembly comprising:

a container member having an open end, said container member including a first thread, said container member further including an inwardly facing wall member;

a lid rotatable about a vertical axis extending through said container member for closing said open end of said container member, said lid including a second thread engageable with said first thread on said container member, said lid further having an outwardly facing tapered wall member; and a seal located on said inwardly facing wall member for engaging said outwardly facing tapered wall member when said lid is assembled with said container member, whereby application of said lid to said container member by rotatably threading said lid onto said container member gradually applies pressure in predominately a horizontal radial direction to said seal between said inwardly facing wall member and said outwardly facing tapered wall member to gradually compress said seal predominately horizontally therebetween, and wherein said inwardly facing wall member and said outwardly facing tapered wall member are free of threads along their entire length, and a path between said seal and an interior of said container member is free of threads when said lid is threadably engaged with said container member.

20. The container assembly according to claim 19, said container member further including an annular skirt member spaced from and encircling at least a main body portion of said container member adjacent said open end, said skirt member having an outer surface including said first thread.

21. The container assembly according to claim 19, wherein said container member includes an upper rim and a lower rim adjacent the inwardly facing wall member of the container member, and said lid includes upper and lower inverted channels for respectively receiving said upper and lower rims therein, thereby forming a tortuous path for fluid movement therepast when said lid is assembled with said container member.

22. The container assembly according to claim 21, wherein said seal is located approximately midway between said upper and lower rims in a groove formed in said inwardly facing wall member.

23. The container assembly according to claim 21, wherein said upper rim and said lower rim are annular and continuous.

24. The container assembly according to claim 21, wherein said upper and lower inverted channels are U-shaped.

25. The container assembly according to claim 19, wherein said seal is an elastomeric O-ring.

26. The container assembly according to claim 19, wherein said inwardly facing wall member is tapered.

27. The container assembly according to claim 19, wherein said inwardly facing wall member is adjacent said open end of said container member.

28. The container assembly according to claim 19, wherein said inwardly facing wall member is tapered.

29. The container assembly according to claim 19, wherein said inwardly facing wall member is adjacent said open end of said container member.

30. A container assembly comprising:

a container member having an open end, said container member including a first thread, said container member further including an inwardly facing tapered wall member;

a lid rotatable about a vertical axis extending through said container member for closing said open end of said container member, said lid including a second thread engageable with said first thread on said container member, said lid further having an outwardly facing wall member; and a seal located on said outwardly facing wall member for engaging said inwardly facing tapered wall member when said lid is assembled with said container member, whereby application of said lid to said container member by rotatably threading said lid onto said container member gradually applies pressure in predominately a horizontal radial direction to said seal between said inwardly facing tapered wall member and said outwardly facing wall member to gradually compress said seal predominately horizontally therebetween, and wherein said inwardly facing tapered wall member and said outwardly facing wall member are free of threads along their entire length, and a path between said seal and an interior of said container member is free of threads when said lid is threadably engaged with said container member.

31. The container assembly according to claim 30, said container member further including an annular skirt member spaced from and encircling at least a main body portion of said container member adjacent said open end, said skirt member having an outer surface including said first thread.

32. The container assembly according to claim 30, wherein said container member includes an upper rim and a lower rim adjacent the inwardly facing tapered wall member of the container member, and said lid includes upper and lower inverted channels for respectively receiving said upper and lower rims therein, thereby forming a tortuous path for fluid movement therepast when said lid is assembled with said container member.

33. The container assembly according to claim 32, wherein said seal is located approximately midway between said upper and lower inverted channels in a groove formed in said outwardly facing wall member.

34. The container assembly according to claim 32, wherein said upper rim and said lower rim are annular and continuous.

35. The container assembly according to claim 32, wherein said upper and lower inverted channels are U-shaped.

36. The container assembly according to claim 30, wherein said seal is an elastomeric O-ring.

37. The container assembly according to claim 30, wherein said outwardly facing wall member is tapered.

38. The container assembly according to claim 30, wherein said inwardly facing tapered wall member is adjacent said open end of said container member.

* * * * *